United States Patent [19]

Schmidt, Jr. et al.

[11] 4,061,350

[45] Dec. 6, 1977

[54] SKATEBOARD

[75] Inventors: Ernest J. Schmidt, Jr.; Michael G. Rinehart, both of Kalamazoo; Bascom D. Blevins, Portage, all of Mich.

[73] Assignee: Dayco Corporation, Dayton, Ohio

[21] Appl. No.: 719,872

[22] Filed: Sept. 1, 1976

[51] Int. Cl.[2] ..... A63C 17/00

[52] U.S. Cl. ..... 280/87.04 A; 280/11.28

[58] Field of Search ..... 280/87.04 A, 11.28, 280/11.19, 11.1, 11.27

[56] References Cited

U.S. PATENT DOCUMENTS

| | | | |
|---|---|---|---|
| 215,081 | 5/1879 | Turnbull | 280/11.27 |
| 329,927 | 11/1885 | Mendenhall | 280/11.28 |
| 1,010,105 | 11/1911 | Zippel | 280/11.27 |
| 3,331,612 | 7/1967 | Tietge | 280/87.04 A |
| 3,355,184 | 11/1967 | Green | 280/11.19 |
| 3,738,673 | 6/1973 | Iseman | 280/11.28 |

FOREIGN PATENT DOCUMENTS

| | | | |
|---|---|---|---|
| 1,225,789 | 7/1960 | France | 280/11.28 |

*Primary Examiner*—David M. Mitchell
*Attorney, Agent, or Firm*—Reuben Wolk

[57] ABSTRACT

A skateboard is provided which has a longitudinal axis and comprises a support member having a top support surface and a bottom surface, a pair of projections fixed to and extending from the member beneath the bottom surface, a pair of wheel assemblies each fastened to an associated projection, and fastening apparatus for fastening each of the wheel assemblies to an associated projection with each fastening apparatus being disposed entirely beneath the bottom surface and comprising components allowing resilient pivoting movement of its wheel assembly in a controlled manner for improved turning of the skateboard and the fastening apparatus includes a pair of resilient elastomeric strips disposed on opposite sides of an axle associated with each wheel assembly with the strips confining its axle within an elongate slot provided in an associated projection.

12 Claims, 9 Drawing Figures

SKATEBOARD

BACKGROUND OF THE INVENTION

Skateboards, i.e., simple board-like structures having wheels thereon in the manner of a single roller skate, are known and have enjoyed varying degrees of popularity through the years. Recently, there has been an increased interest in skateboards by both children and adults.

However, it is a problem to provide a reliable and rugged skateboard at an economical cost while assuring such skateboard has optimum turning capabilities.

SUMMARY

It is a feature of this invention to provide a skateboard which is of simple and economical construction.

Another feature of this invention is to provide a skateboard which is of rugged construction and is capable of withstanding substantial riding abuse while still affording turning capabilities.

Another feature of this invention is to provide a skateboard which has simple and unique means operatively associated with a pair of spaced axles thereof which cause such axles to make a so-called crab action which enables better turning thereof.

Another feature of this invention is to provide a skateboard of the character mentioned which employs strips of selected resilient elastic rubber-like material which are subjected to compressive stresses by associated axles during turning and such strips restore the axles to their original positions once a turn has been made thereby assuring optimum simplicity in the turning or steering means for the skateboard.

Another feature of this invention is to provide a skateboard of the character mentioned having a pair of wheel assemblies each comprised of a rigid axle wherein each axle is held against axial movement by a simple so-called hitch pin and each hitch pin makes substantially point contact with its axle.

Accordingly, it is an object of this invention to provide an improved skateboard having one or more of the novel features set forth above or hereinafter shown or described.

Other details, features, objects, uses, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DESCRIPTION OF ILLUSTRATED EMBODIMENTS

Figure 1:
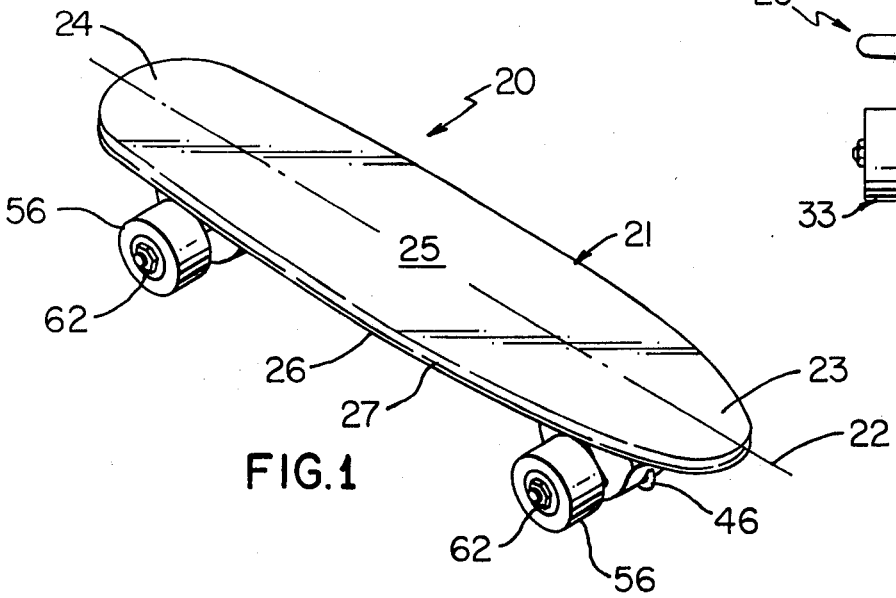
FIG. 1 is a perspective view illustrating one exemplary embodiment of the skateboard of this invention.

Reference is now made to FIG. 1 of the drawings which illustrates one exemplary embodiment of a skateboard of this invention which is designated generally by the reference numeral 20. The skateboard 20 comprises an elongate support member 21 having a longitudinal axis 22 and rounded opposed ends comprised of a front end 23 and a rear end 24 with the end 23 having a comparatively more pointed yet rounded configuration or peripheral outline and the end 24 having a roughly semicircular peripheral outline. The support member 21 has a top substantially planar support surface 25 and a bottom surface 26; and, the entire peripheral edge 27 of the support member 21, including along its sides and opposed ends 23 and 24, has a rounded approximately semicircular outline free of sharp edges for optimum safety for users of the skateboard 20.

Figure 2:
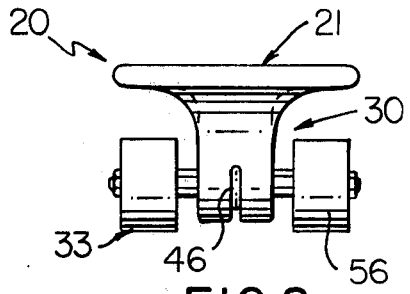
FIG. 2 is a front view of the skateboard of FIG. 1.
Figure 3:
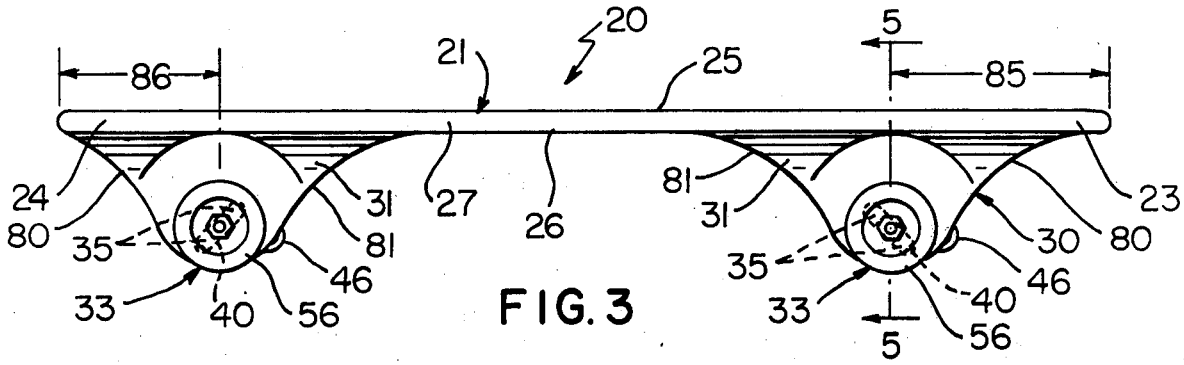
FIG. 3 is a side view of the skateboard of FIG. 1.

The skateboard 20 has projection means indicated generally by the reference numeral 30 in FIG. 2 extending from its member 21 beneath the bottom surface 26 thereof and as best seen in FIG. 3 of this example of the skateboard such projection means includes a pair of lug-like projections each designated by the same reference numeral 31 extending from the bottom surface 26. The lug-like projections 31 are defined as an integral part of the support member 21 as a single piece construction and of the same material, see FIGS. 5 and 7.

Figure 4:
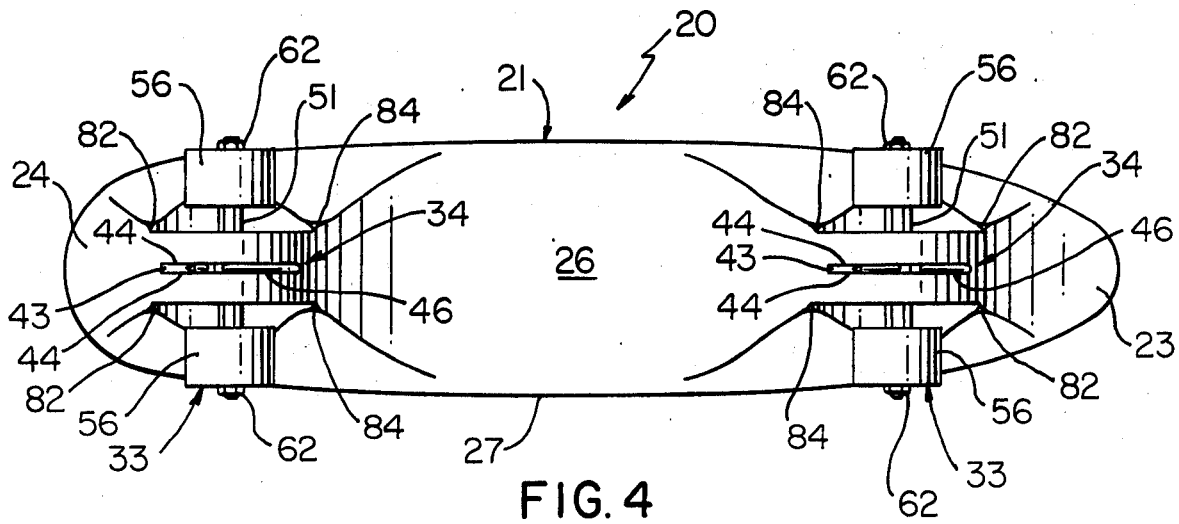
FIG. 4 is a bottom view of the skateboard of FIG. 1.
Figure 5:
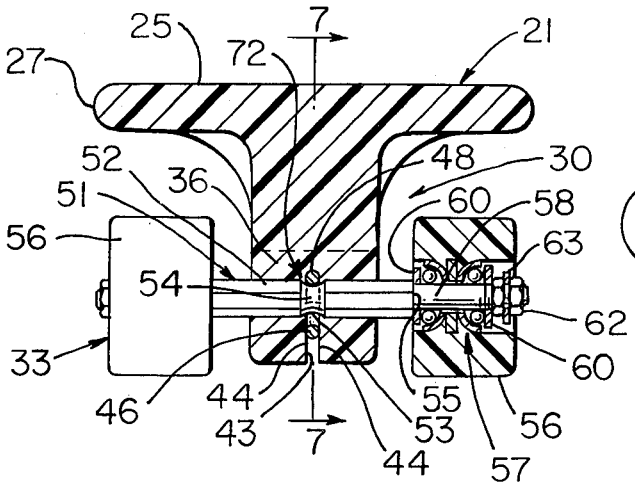
FIG. 5 is a view taken essentially on the line 5—5 of FIG. 3 and illustrating the main member of the skateboard in cross section, a hitch pin, and one wheel of an associated wheel assembly with its associated anti-friction bearing in cross section with the axle and the other wheel being shown in elevation.
Figure 7:
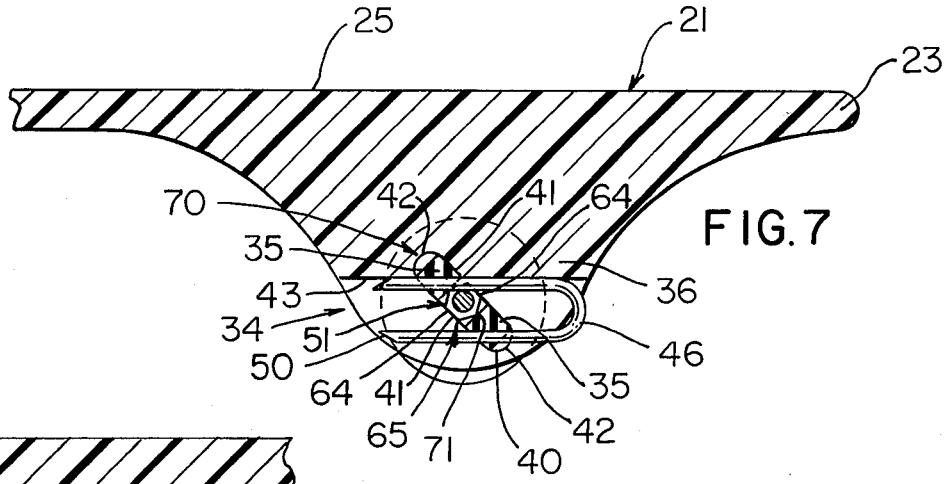
FIG. 7 is a view taken essentially on the line 7—7 of FIG. 5 and showing the hitch pin in elevation.
Figure 8:
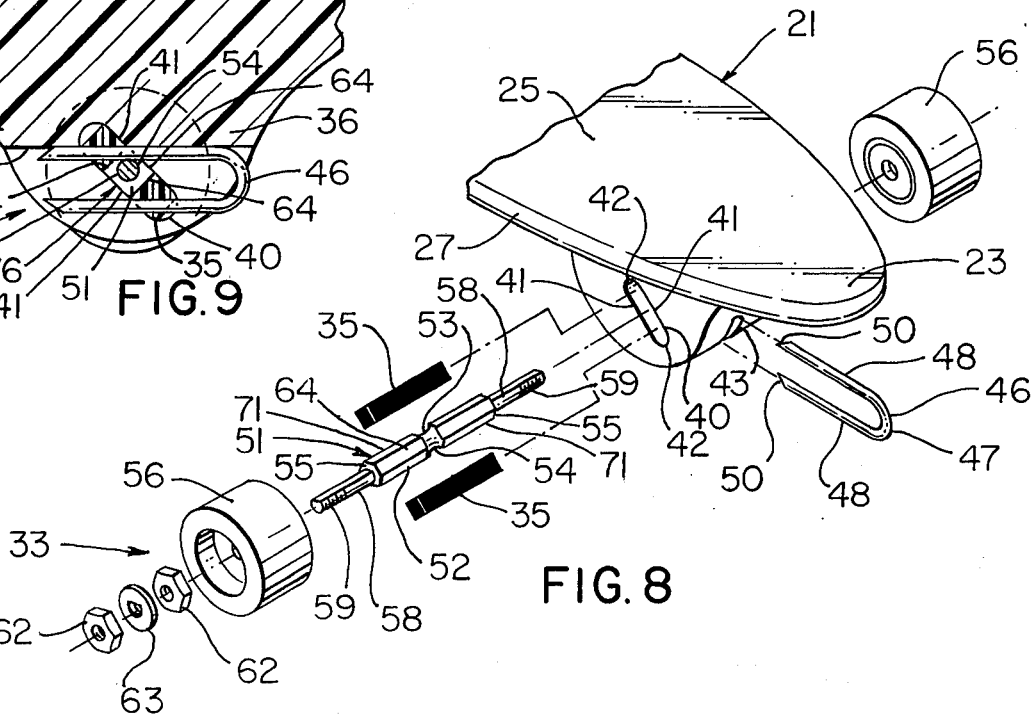
FIG. 8 is a fragmentary perspective view illustrating selected components of the front wheel assembly of the skateboard of FIG. 1 exploded from their normal positions.

The skateboard 20 has a pair of wheel assemblies, see FIGS. 4 and 5, each designated by the same reference numeral 33, and has fastening means 34 for each wheel assembly 33 disposed entirely beneath the bottom surface 26, also see FIGS. 7 and 8, and such fastening means 34 serve to fasten the wheel assemblies 33 to the projection means 30 and in particular to the lug-like projections 31 defining such projection means 30. The fastening means 34 for each wheel assembly 33 comprises means in the form of a pair of resilient elastomeric strips 35 which allow movements of its wheel assembly 33 in a controlled elastic-like manner for improved turning of the skateboard 20.

Each lug-like projection 31 has a bottom portion 36 provided with a substantially semicircular peripheral outline when viewed from a side thereof as shown in FIGS. 3 and 7, and the fastening means 34 is comprised of a pair of elongate slots 40, see FIG. 8, each extending completely through its associated projection 31 and each being defined by a pair of parallel substantially flat surfaces 41 interconnected at associated end edges by semicircular surfaces 42. The fastening means 34 comprising each projection 31 includes a central groove 43, see FIG. 5, which has the appearance of being defined by a saw-cut, and the groove 43 bisects its lug-like projection and is defined by opposed flat or planar surfaces 44 interconnected at the top thereof by a rounded semicylindrical surface 43. The fastening means 34 also includes a U-shaped staple-like member 46 defined by a bight 47 and a pair of legs 48 terminating in sharp edges 50 and the member 46 is often referred to as a hitch pin 46.

Thus, it is seen that the slots 40 with the various surfaces defining such slots, the cutouts 43 with the various surfaces defining such cutouts, the hitch pins or U-shaped members 46, and the elastomeric strips 35 comprise fastening means for the wheel assemblies 33; and, the manner in which such fastening means are utilized to fasten associated wheel assemblies 33 in position will be described in detail after a description of such wheel assemblies.

The wheel assemblies 33 are substantially identical whereby the detailed description will proceed with a description of only one wheel assembly which is fully applicable to both and for this description reference is made to FIGS. 5 and 8 of the drawings. Each wheel assembly 33 is comprised of an axle which is designated generally by the reference numeral 51 and the axle has a central portion 52 which is comparatively larger in cross-sectional configuration than opposite ends thereof and in this example has a hexagonal configuration. The central portion 52 has a cutout groove 53 therein which is provided for a purpose to be explained in detail later and the groove 53 is defined by an annular surface 54 of outwardly concave configuration. The axle 51 also has a pair of shoulders 55 defining opposite sides of the hexagonal central portion 52 and the purpose of each shoulder will be defined in detail subsequently. The axle 51 also has a pair of end portions 58 each disposed outwardly of an associated shoulder 55 and each portion 58 has threads 59 defining its terminal end.

Each wheel assembly 33 has a pair of wheels 56 which may be made of a suiable elastomeric material and each wheel has anti-friction bearing means shown as a roller bearing assembly 57 provided therein which includes a pair of washers 60 which define opposite sides thereof. One of the washers 60 is provided substantially coplanar with its wheel 56 and is adapted to engage an associated shoulder 55. Each wheel 56 is held with its coplanar washer 60 against a shoulder 55 by a pair of threaded nuts 62 which are threaded over associated threads 59 and have a lock washer 63 suitably fastened therebetween.

Each bearing assembly 57 of each wheel 56 provides anti-friction rotation thereof about an associated axle 51; and, each axle is prevented from rotating once installed in an associated lug-like projection 31 by opposed flat surfaces 64 of the hexagonal central portion engaging surfaces 41 defining an associated elongate slot 40 and as seen at 65 in FIG. 7.

The fastening means 34 comprises means allowing resilient pivoting movements of the wheel assemblies 33 and in particular of each wheel assembly 33 and such fastening means 34 for each wheel assembly 33 includes the previously mentioned pair of elongated strips 35 of elastomeric material. The strips 35 of this example are shown made of rubber and have a rectangular cross-sectional configuration which is in the form of a square and once each axle 51 is inserted through an associated slot 40 the central hexagonal portion thereof has at least one flat surface 64 (two flat surfaces 64 in this example) engaging associated surfaces 41 defining opposed walls or surfaces of an associated elongate slot 40 in a lug-like projection 31 which prevents rotation of the axle 51 as mentioned earlier. The strips 35 are disposed on opposite sides of the central portion 52 of its axle 51 and confine such axle against movement along the elongated dimension of its slot 40 and for this purpose the corners of each strip 35 engage an associated rounded surface 42 of a slot 40 as shown typically at 70 in FIG. 7.

Each axle 51 is aligned in position so that its annular groove 53 is disposed in an associated cutout 43 whereupon the hitch pin or member 46 is pierced through the associated rubber members 35 as shown in FIG. 7 thereby confining the axle 51 against axial movement. It will be appreciated that the dimensions of the members 35, slot 40, and axle 51 associated therewith are such that each axle is confined against movement along the slot 40 in a yielding and resilient manner. Further, the yielding resistance offered by members 35 enables steering of the skateboard 20 even at high speeds thereof.

The provision of an axle 51 having a hexagonal central portion 52 results in flat portions 64 engaging surfaces 41 and sharp edge portions 71 of the central portion 52 engaging the rubber members 35 in a line contact arrangement whereby any tendency to move each axle 51 transverse the longitudinal axis 22 of the skateboard and along its slot 40 results in a yielding deformation of the associated rubber strips 35 and a restoring force for the axle 51 in a more precise manner than would be possible if larger surface areas of axle 51 and strips were to be in contact. In addition, this is a more precise restoring force for the axle 51 than is possible employing elastomeric components which are placed in torsion.

The member 46 of the fastening means 34 has only one leg 48 thereof engaging surface 54 defining the annular cutout 53 in the central portion 52 of an associated axle 51 and with such leg 48 being cylindrical there is, in essence, a point contact as shown at 72, for example, between such leg 48 and the surface 54. This point contact allows each axle 51 to pivot around such point with the rubber strips 35 serving as the sole means for restoring the axle 51 and thus the associated wheel assembly 33 to its original position beneath and perpendicular to the longitudinal axis 22. It will also be seen that the sharp pointed edges 50 of the legs 48 of member 46 are disposed inwardly of the peripheral outline of an associated lug-like projection 31 for optimum safety.

Figure 6:
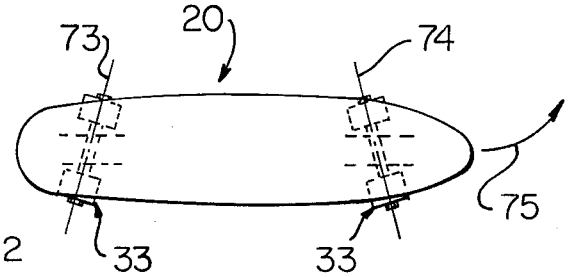
FIG. 6 is a view illustrating what will be referred to as a crab action provided by the axles of the wheel assemblies of the skateboard of this invention.

The elongate slots 40 are inclined relative to the longitudinal axis 22 so that imaginary planes bisecting such slots and each extending between surfaces 41 defining a slot 40 extending in lugs 31 intersect at a location between the axles 51 and define a downwardly opening included angle, whereby the slots 40 will be referred to as having their axes disposed in opposite directions. This arrangement of the slots 40 and the action of the cooperating components of the fastening means 34 results in the axles being inclined in opposed directions as shown at 73 and 74 in FIG. 6 during a left turn as shown by the arrow 75 and this results in what will be referred to as a crab action enabling an easier left turn. During a right turn, (not shown) the axles are inclined in a reverse manner so that they diverge in an opposite direction enabling an easier right turn.

The axles 51 are controlled by the strips 35 with a precise resiliency which tends to restore each axle 51 to its original position perpendicular to the longitudinal axis 22. The utilization of a restoring force directly against axles 51 exerted by an elastic compressible member makes it possible to provide the skateboard 20 with more precisely controlled steering or guiding.

In the exemplary skateboard 20 the central portion 52 of the axle 51 is provided with a substantially hexagonal configuration throughout its length. However, it will be appreciated that central portion need not necessarily be hexagonal and may be any shape as long as it has a flat surface engaging at least one surface 41. For example, the central portion may be square as shown at 76 for the axle 51 illustrated in FIG. 9 of the drawings. The square axle 51 has opposed flat surfaces 64 and a central annular cutout 53 defined by a concave cylindrical surface 54. With an axle 51 having a square central portion one pair of opposed surfaces 64 engage surfaces 41 of a lug-like projection 31 and the other pair of opposed flat surfaces engage the elastomeric plastic strips 35 thereby providing a comparatively large contact area and corresponding larger bearing surface which offers more resistance to compression whereby a skateboard 20 having an axle 51 with a square central portion will have stiffer turning capabilities due to its greater resistance to turning. However, it will be appreciated that the tendency for each strip 35 to return to its original position upon being compressed and hence the steering of the skateboard 20 may be precisely controlled by the selection of strips 35 having the desired physical properties.

The support member 21 comprising the skateboard 20 of this invention may be made of any suitable comparatively inexpensive material and in accordance with any technique known in the art. Preferably, the support member 21 with its integral lug-like projections is made as a single piece member of a synthetic plastic material. The construction and arrangement thereof is such as to provide smooth radii blending the lug-like projections with the main body of the support member 21 as illustrated typically at 80, 81, 82, and 84 in FIGS. 3 and 4. This construction and arrangement allows the lug-like projections to provide optimum support with minimum stress concentrations. Materials which may be used to make the support member 21 include nylon, polyethylene, polycarbonate, and similar materials.

Each bearing assembly 57 comprising the skateboard may be made of any suitable material and in this example each bearing assembly 57 is preferably made of metal parts in accordance with techniques known in the art. In addition, each axle, washer, lock nut, and the like, associated with each assembly 57 is also made of metal; and, the hitch pin 46 is also preferably made of a metallic material.

Figure 9:
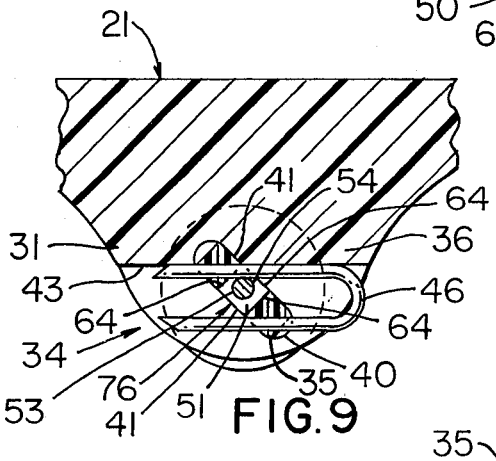
FIG. 9 is a view similar to the lower portion of FIG. 7 illustrating a modified axle which may be used in the skateboard of FIG. 1 in lieu of the axle illustrated.

The elastomeric strips 35 of the skateboard 20 may be made of either rubber or a suitable synthetic plastic material and in the embodiment of FIG. 9, it will be seen that such strips 35 are cross hatched as being made of plastic.

The skateboard 20 has a portion 85 which extends forwardly of a vertical plane through the front axle 51 which is longer than a portion 86 thereof which extends rearwardly of a vertical plane through the rear axle 51 and this construction is for the well-known purpose of helping to tilt the skateboard forwardly and aid in steering.

While present exemplary embodiments of this invention, and methods of practicing the same, have been illustrated and described, it will be recognized that this invention may be otherwise variously embodied and practiced within the scope of the following claims.

What is claimed is:

1. A skateboard having a longitudinal axis and comprising, a support member having a top support surface and a bottom surface, a pair of projections fixed to and extending from said member beneath said bottom surface, a pair of wheel assemblies each fastened to an associated projection, and fastening means for fastening each of said wheel assemblies to an associated projection with each fastening means being disposed entirely beneath said bottom surface and comprising means allowing resilient pivoting movements of its wheel assembly in a controlled manner for improved turning of said skateboard, each of said fastening means in each projection comprising an elongate slot extending transversely through its associated projection, said elongate slots being inclined in opposed directions, each of said slots being defined by a pair of spaced planar surfaces adjoined at opposite ends thereof by interconnecting surfaces, each of said wheel assemblies comprising an axle having a central portion provided with a cooperating surface which engages an associated planar surface of its projection, said associated planar surface engaging said cooperating surface holding the axle against rotation relative to its projection, said fastening means further comprising a pair of resilient elastomeric strips disposed on opposite sides of its axle confining its axle within its elongate slot, each strip having portions thereof compressed during turning of the skateboard with the compressed portions serving to restore the associated axle to its original position after turning.

2. A skateboard as set forth in claim 1 in which each projection has a groove extending parallel to said axis bisecting the width of the projection and bisecting its slot, each of said axles has a portion provided with an annular groove defined by an outwardly concave annular surface, and said fastening means further comprises a fastening pin which is disposed in said groove and has a part thereof pierced through at least one of said strips and engaging said outwardly concave annular surface in point-to-point contact therewith enabling its axle to pivot in a substantially unobstructed manner during turning of said skateboard while preventing axial movement of the axle along its projection.

3. A skateboard as set forth in claim 2 in which the central portion of each axle has a hexagonal cross-sectional configuration and has said outwardly concave annular surface provided in the center thereof.

4. A skateboard as set forth in claim 2 in which the central portion of each axle has a square cross-sectional configuration and has said outwardly concave annular surface provided in the center thereof.

5. A skateboard as set forth in claim 2 in which each of said strips is made of a rubber material and has a rectangular cross-sectional configuration.

6. A skateboard as set forth in claim 2 in which each of said strips is made of a synthetic plastic material and has a rectangular cross-sectional configuration.

7. A skateboard as set forth in claim 2 in which said fastening pin is a staple-like member having a U-shaped configuration defined by a bight and a pair of parallel legs extending from opposite ends of said bight and said part of said fastening pin pierced through one of said strips is one of said legs.

8. A skateboard as set forth in claim 7 in which said fastening pin is made of metal and each of said legs has sharp pointed ends disposed within the peripheral outline of its projection.

9. A skateboard as set forth in claim 2 in which each of said wheel assemblies comprises a pair of wheels each rotatably supported on its axle by a roller bearing assembly.

10. A skateboard as set forth in claim 2 in which said support member is made of a synthetic plastic material.

11. A skateboard as set forth in claim 2 in which said support member is made of a synthetic plastic material, and said elongate slots are provided in said projections and inclined in opposite directions at substantially the same angle relative to said longitudinal axis.

12. A skateboard as set forth in claim 1 in which said pair of projections are defined as an integral part of said suppot member as a single-piece construction.

* * * * *